US005436874A

United States Patent [19]

Kuhn et al.

[11] Patent Number: 5,436,874

[45] Date of Patent: Jul. 25, 1995

[54] METHOD AND APPARATUS FOR SENSING ACOUSTIC SIGNALS IN A LIQUID

[75] Inventors: Philip M. Kuhn, Severna Park; Frank P. Hodges, Catonsville, both of Md.

[73] Assignee: Martin Marietta Corporation, Syracuse, N.Y.

[21] Appl. No.: 153,949

[22] Filed: Nov. 17, 1993

[51] Int. Cl.[6] ..... H04R 17/00

[52] U.S. Cl. ..... 367/176; 310/326; 310/337; 367/162

[58] Field of Search ..... 367/162, 176, 153, 173; 310/326, 337, 326

[56] References Cited

U.S. PATENT DOCUMENTS

| | | | |
|---|---|---|---|
| 3,409,869 | 11/1968 | McCool et al. | 367/153 |
| 3,923,118 | 12/1975 | Johansen | 181/286 |
| 4,164,727 | 8/1979 | Morris | 181/284 |
| 4,390,976 | 6/1983 | Eynck | 367/153 |
| 4,488,271 | 12/1984 | Held et al. | 367/151 |
| 4,669,573 | 6/1987 | Goodman | 181/286 |
| 4,674,595 | 6/1987 | Henriquez | 181/286 |
| 4,779,244 | 10/1988 | Horner et al. | 367/140 |
| 4,817,757 | 4/1989 | Perrett et al. | 181/288 |
| 4,928,264 | 5/1990 | Kahn | 367/141 |
| 4,949,317 | 8/1990 | McQuitty et al. | 367/176 |
| 5,007,030 | 4/1991 | Sullivan et al. | 367/153 |
| 5,287,332 | 2/1994 | Lea | 367/153 |

FOREIGN PATENT DOCUMENTS

| | | | |
|---|---|---|---|
| 2063007 | 5/1981 | United Kingdom | 367/176 |

*Primary Examiner*—Ian J. Lobo

*Attorney, Agent, or Firm*—Paul Checkovich; Stephen A. Young

[57] ABSTRACT

An apparatus for sensing acoustic signals in a liquid wherein an omnidirectional hydrophone exhibits a hemispheric response pattern. A hydrophone, including a transducer element and a transmitting cable, is mounted such that the transducer element is adjacent the forward face of an acoustic baffle including a layer of sound-absorbing material. The rear face of the acoustic baffle is positioned adjacent an acoustic shield including a layer of sound-reflecting material. The transmitting cable is positioned in an aperture in the acoustic baffle and the acoustic shield, and passes beyond the rear face of the acoustic shield. A flow fairing is positioned adjacent the forward face of the acoustic baffle and encloses at least the forward portion of the transducer element.

1 Claim, 4 Drawing Sheets

METHOD AND APPARATUS FOR SENSING ACOUSTIC SIGNALS IN A LIQUID

FIELD OF THE INVENTION

The present invention relates generally to the field of underwater acoustics, and particularly to the use of a sound-absorbing baffle to alter the isonification pattern of an omnidirectional hydrophone.

BACKGROUND OF THE INVENTION

The present invention is directed to achieving a hemispheric isonification pattern from a wide-band omnidirectional hydrophone mounted on a sound-absorbing baffle. The invention obtains hemispheric directional response and uniform sensitivity over a broad band of frequencies from a hydrophone designed to exhibit a spherical directional response.

In the field of underwater acoustics, it is desirable to have a hydrophone that exhibits a hemispheric directional response. Hemispheric directional response results from a hydrophone that detects only those sound waves emanating from points within a 180° sector defined from the receiving element of the hydrophone. Additionally, it is desirable for such a hydrophone to exhibit a uniform open circuit receiving response over a wide frequency band; that is, the hemispheric response pattern should be relatively uniform over a broad range of frequencies. Such a device is particularly useful for determining the distance between an array of such hydrophones and an underwater object. Devices of this type might typically be mounted in some fashion on a submarine, and thus must also be designed to withstand pressures exerted at submarine depths.

Certain commercially-available hydrophones are particularly well-suited to this type of application, possessing an optimum combination of several competing performance parameters including depth capacity, charge sensitivity and diffraction field size. One such hydrophone consists of a thin-walled spherical shell of piezoelectric ceramic waterproofed by a thin shell of rubber or polyurethane encapsulant. This type of hydrophone, however, normally exhibits a spherical isonification pattern, detecting sounds emanating from points within a 360° arc defined from its receiving element.

Previous efforts to achieve hemispheric isonification of a spherical hydrophone while maintaining desired performance characteristics have met with limited success, and typically have involved mounting the hydrophone on a sound-reflecting surface. While the reflecting surface blocks sound waves emanating from points behind the hydrophone, thus achieving a substantially hemispheric isonification pattern, a significant problem is presented by the sensing of standing waves in the vicinity of the hydrophone generated by sound impinging on the face of the reflecting surface nearest the hydrophone. This problem is greatest at higher frequencies, where short wave reflections tend to destroy the uniformity of the hemispherical pattern. Prior approaches to solving this problem involved the use of multiple hydrophones, each of which exhibit satisfactory response characteristics over a limited frequency range. To achieve broad band response with limited interference from standing waves, it was necessary to switch from one hydrophone in the array to another hydrophone as the frequency varied.

The present invention solves the standing wave problem by mounting an omnidirectional hydrophone adjacent to an acoustic baffle, resulting in hemispheric directional response and uniform frequency response over a broad range of frequencies. The present invention offers the additional advantages of simplicity of design and fabrication.

SUMMARY OF THE INVENTION

The present invention provides an apparatus for sensing acoustic signals in a liquid. The invention is directed to achieving a hemispheric isonification pattern from a wide-band hydrophone designed to produce a substantially spherical isonification pattern, while avoiding unwanted interference caused by standing waves in the vicinity of the hydrophone.

The apparatus of the present invention includes an acoustic baffle. The acoustic baffle may be constructed of any sound-absorbing material known in the art, such as syntatic foam or rubber, which exhibits sound dampening characteristics sufficient to prevent reflection of sound waves across a desired frequency range. A preferred syntatic foam composite consists of small chunks of lossy lead-filled rubber mixed with tiny glass microspheres and epoxy to form a solid homogenous mass. When positioned behind the spherical transducer element of a typical omnidirectional hydrophone, the acoustic baffle absorbs sound waves that do not impinge directly on the forward hemisphere of the transducer element, thereby ensuring that such sound waves are not reflected back towards the transducer element and detected by the rear hemisphere.

The apparatus of the present invention also includes an acoustic shield. The acoustic shield may be constructed of any sound-reflecting material known in the art, such as stainless steel, brass or lead, which exhibits sound reflecting characteristics sufficient to prevent penetration by sound waves across a desired frequency range. The acoustic shield may comprise a distinct structure, such as a backing plate, or may be part of a structure on which a hydrophone is mounted, such as the hull of a vessel. When positioned on the opposite side of an acoustic baffle from a spherical transducer element, the acoustic shield reflects sound waves that would otherwise impinge on the rear hemisphere of the transducer element. Thus, the combination of an acoustic baffle and an acoustic shield ensures the hydrophone only registers sound waves impinging on its forward face, thereby achieving hemispheric isonification.

The apparatus of the present invention may optionally include a flow fairing. The flow fairing may be constructed of any sound-permeable material known in the art, such as polyurethane or rho-C rubber, which offers little or no obstruction to sound waves in a desired frequency range transmitted through water. Such a flow fairing should be constructed in accordance with generally-accepted hydrodynamic principles to minimize any turbulence generated by moving water contacting the flow fairing. Such a flow fairing would typically present a tapered leading edge.

An embodiment of the present invention includes an acoustic shield, comprising a steel backing plate, an acoustic baffle, comprising a layer of syntatic foam, and a flow fairing, comprising a hydrodynamically-shaped layer of polyurethane. The rear face of the acoustic baffle is secured to the forward face of the acoustic shield, and an aperture passes through both layers. The hydrophone is mounted such that the base of the hydrophone's transducer element is flush with the forward face of the acoustic baffle and the hydrophone's transmitting cable extends through the aperture. The entire apparatus may then be affixed to the exterior hull of a vessel.

The acoustic shield prevents sound waves emanating from points behind the hydrophone from being detected. Likewise, the acoustic baffle prevents sound waves emanating from points in front of the hydrophone, but which do not impinge directly on the forward hemisphere of the hydrophone, from being detected. Additionally, and unlike prior art applications, the acoustic baffle of the present invention does not generate a significant amount of unwanted standing waves. Sound waves that do not impinge directly on the hydrophone surface are absorbed by the acoustic baffle instead of being reflected as standing waves. This apparatus, including both absorbing and reflecting components, thus enables a spherical hydrophone to exhibit a truer hemispheric isonification pattern than was possible in the prior art.

In another embodiment of the present invention, the acoustic shield actually comprises a portion of the hull of a vessel on which the hydrophone is mounted.

In yet another variation on this embodiment, the entire apparatus may be suspended from a structure by means of a bracket. The bracket may be fixedly attached to the structure, or may be rotatably attached to a drive means on the structure. For rotatable attachment, the bracket ideally contains an offset portion between its upper and lower ends of sufficient degree to align the core of the transducer element with the bracket's axis of rotation. The acoustic shield comprises a sheet of acoustic-reflecting material substantially larger than the diameter of the transducer element to ensure shielding from sound waves emanating behind the transducer. The acoustic baffle comprises a sheet of acoustic-absorbing material of substantially the same size as the acoustic shield.

DETAILED DESCRIPTION

Figure 1:
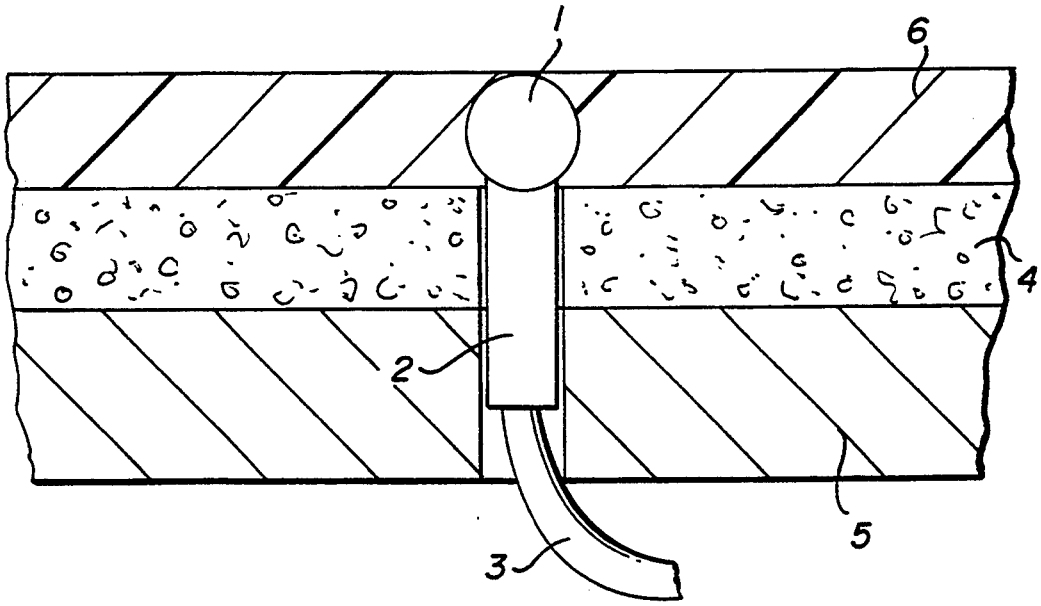
FIG. 1 is a cross-sectional view of an apparatus for sensing acoustic signals in a liquid according to the present invention.

FIG. 1 depicts an apparatus for sensing acoustic signals in a liquid according to the present invention. A wide band omnidirectional hydrophone includes a spherical transducer element 1, a mounting stem 2 and a transmitting cable 3. The apparatus includes an acoustic baffle 4 positioned adjacent to an acoustic shield 5. In mounting the hydrophone, the spherical transducer element 1 is positioned such that the base of the sphere is flush with the forward face of the acoustic baffle 4. The mounting stem 2 and the transmitting cable 3 extend from the spherical transducer element 1 into an aperture passing through both the acoustic baffle 4 and the acoustic shield 5. The transmitting cable 3 is adapted to carry electrical signals to and from the spherical transducer element 1.

Figure 2:
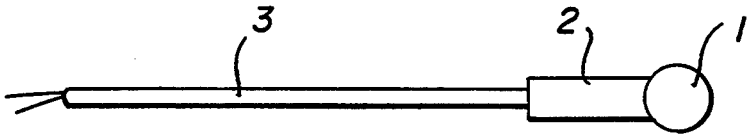
FIG. 2 is a schematic of an omnidirectional hydrophone of the type capable of use with the present invention.

FIG. 2 provides a schematic of an omnidirectional hydrophone capable of use with the present invention. A commercially-available example of such a device is the EDO Western Model 6600 transducer, which is effective as a receiving hydrophone over a frequency range of 500 Hz to 400 kHz. The transducer element 1 comprises a sphere of lead-titanate-ziconate ceramic material encapsulated in urethane and secured to a stem mount 2. A transmitting cable 3, comprising a twisted pair with a braided shield, extends from the stem mount 2. A transducer of this type exhibits an essentially spherical response pattern with only minor deviations in its vertical directivity caused by the stem mount 2. While the present invention is described with reference to this particular type of hydrophone, it will be apparent to those skilled in the art that other hydrophones are equally compatible with the present invention.

Referring again to FIG. 1, the acoustic shield 5 is constructed of a sound-reflecting material, such as stainless steel. Stainless steel is particularly well-suited to this application since it presents a high level of acoustic impedance as a result of its density. The acoustic shield 5, in addition to providing a rigid surface for supporting the acoustic baffle 4, shields the hydrophone from unwanted background noises such as might emanate from the interior of a vessel to which the apparatus is attached.

The acoustic baffle 4 may be constructed of any composite material, such as syntatic foam, which exhibits limited variation in acoustic properties at depths up to and exceeding submarine depths (typically from one thousand to two thousand feet). A preferred syntatic foam known in the art consists of small chunks of lossy lead-filled rubber mixed with tiny glass microspheres and epoxy to form a solid homogenous mass. This composite presents a high loss factor for impinging sound waves over a wide frequency range. The acoustic baffle 4 absorbs sound waves impinging in the vicinity of the spherical transducer element 1 so that the hydrophone is isonified only on the hemispheric surface opposite the acoustic baffle 4.

In one embodiment of the present invention, the apparatus comprises a discrete unit that may be attached to a structure. The acoustic shield 5 and the flow fairing 6 may be adhesively bonded to respective faces of the acoustic baffle 4. The apparatus may then be detachably fastened to the exterior of a structure by means of fasteners, with the transmitting cable 3 passing into the interior of the structure.

Alternatively, the individual layers of the apparatus could be housed in a frame or detachably secured to one another with fasteners. Such a configuration would permit individual elements of the apparatus to be replaced without the need to replace the entire unit.

Figure 3:
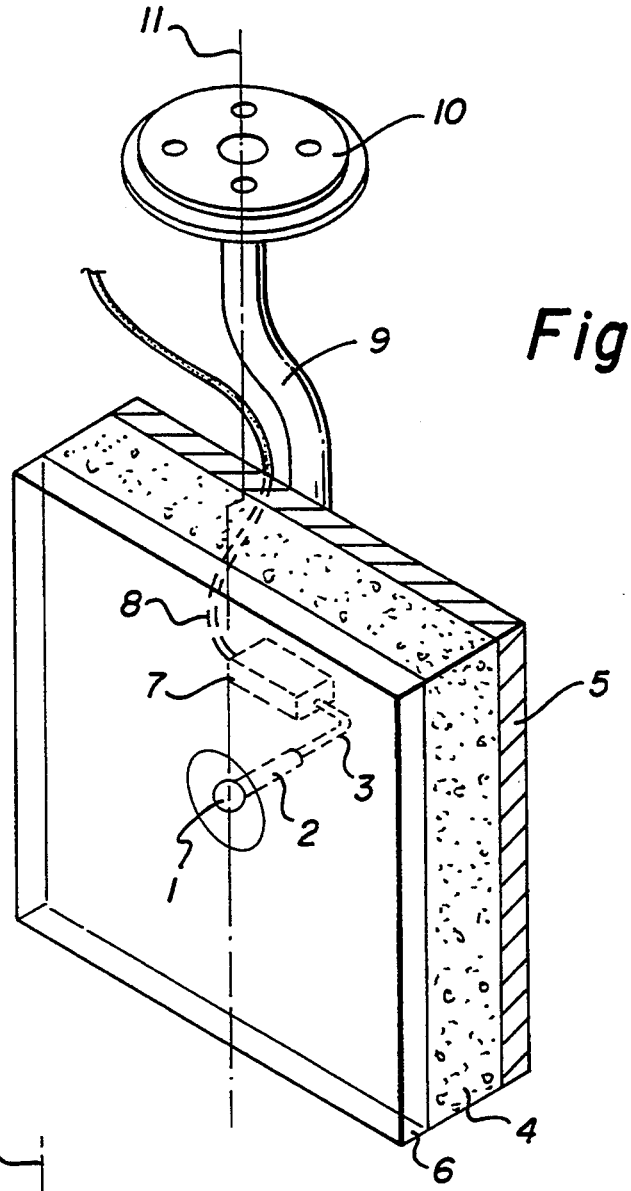
FIG. 3 is an example of the present invention wherein the apparatus is suspended from a structure by a mounting bracket.

FIG. 3 shows an example that demonstrates some of the features and advantages of the present invention. Other features and advantages will be readily apparent to those skilled in the art.

Referring to FIG. 3, the acoustic baffle/acoustic shield portion of the apparatus is configured as in FIG.

1. A spherical transducer element 1 is mounted such that its base is flush with the forward face of the acoustic baffle 4. Here, the acoustic baffle 4 comprises a 2 foot by 2 foot square of syntatic foam approximately 3 inches thick. It will be apparent to those skilled in the art that the thickness of the acoustic baffle 4 may be varied depending on the sound-absorbing characteristics of the particular material from which it is constructed.

The acoustic baffle 4 is positioned adjacent to the acoustic shield 5, which comprises a 2 foot by 2 foot steel plate approximately 1 inch thick. Again, it will be apparent to those skilled in the art that the thickness of the acoustic shield 5 may be varied depending on the sound-reflecting characteristics of the particular material used.

The stem mount 2 and transmitting cable 3 pass through an aperture in the acoustic baffle 4 and the acoustic shield 5. A flow fairing 6 is positioned adjacent to the forward face of the acoustic baffle 4 to shield the spherical transducer element 1 from unwanted interference caused by water turbulence. The flow fairing 6 comprises a 2 foot by 2 foot layer of polyurethane with an impression in its rear face to accommodate the spherical transducer element 1. The forward face of the flow fairing 6 is bubble-shaped, presenting a tapered leading edge in the vicinity of the transducer element 1.

The transmitting cable 3 is detachably connected to a preamplifier 7, which is itself secured to the rear face of the acoustic shield 5, to enhance the acoustic signals detected by the hydrophone. The preamplifier 7 may be any suitable device known in the art. A preamplifier cable 8 connects the preamplifier 7 to means for monitoring the detected acoustic signals (not shown).

Figure 4:
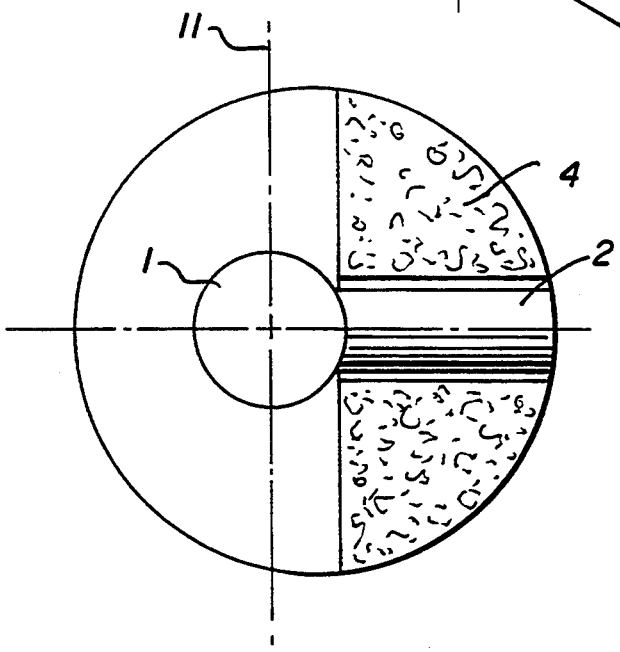
FIG. 4 is an isolated view of the suspended spherical transducer element of the apparatus in FIG. 3.

A mounting bracket 9 suspends the other components of the apparatus. The lower end of the mounting bracket 9 is attached to the rear face of the acoustic shield 5, while the upper end forms a mounting flange 10. The mounting flange 10 may be rotatably attached to a rotation drive means (not shown) on a vessel (e.g., a submarine or a surface-going ship). The mounting bracket 9 contains an offset portion such that its axis of rotation 11 passes through the core of the spherical transducer element 1. FIG. 4 provides an isolated view of the spherical transducer element 1 to more clearly illustrate this orientation.

Figure 5:
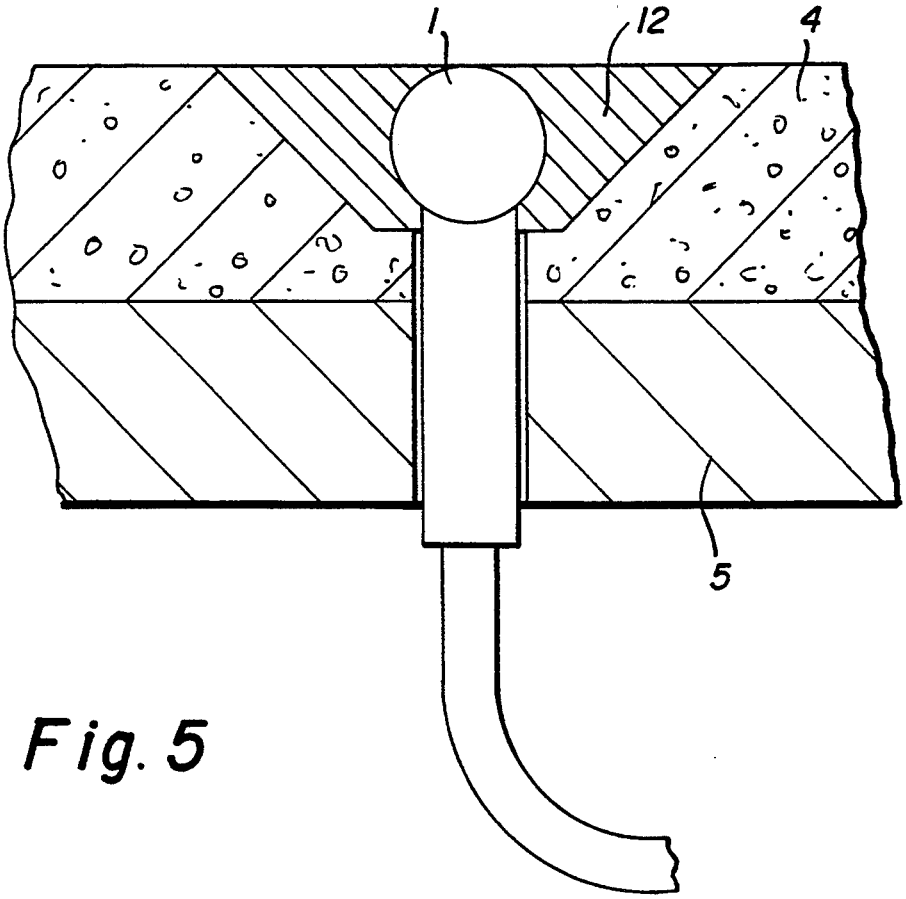
FIG. 5 is a cross-sectional view of an embodiment of the present invention wherein the transducer lies in a recessed portion of the acoustic baffle.

FIG. 5 shows a possible variation for a listening apparatus according to the present invention. This embodiment also includes an acoustic shield 5 and an acoustic baffle 4; however, the flow fairing does not comprise a layer completely covering the acoustic baffle 4 as it did in FIG. 3. Instead, the acoustic baffle 4 contains a recessed portion 12 housing the spherical transducer element 1. This recessed portion 12 is filled with polyurethane to shield the hydrophone from unwanted interference produced by water turbulence.

Figure 6:
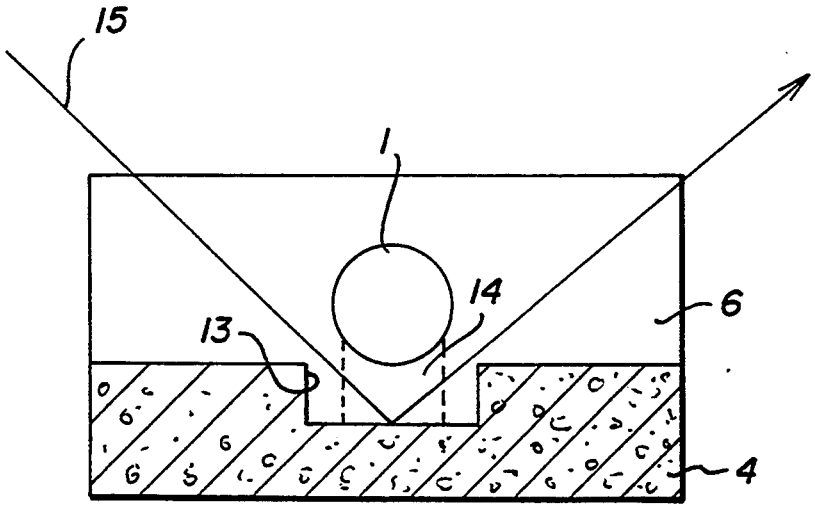
FIG. 6 is a cross-sectional view of an embodiment of the present invention wherein the transducer lies above a recessed portion of the acoustic baffle.

FIG. 6 shows a cross-sectional view of a portion of yet another embodiment of a listening apparatus according to the present invention. In this embodiment, the acoustic baffle 4 includes a counterbore 13 comprising a recess in the upper surface of the acoustic baffle 4. The length and width of the counterbore 13 are preferably substantially larger than the circumference of the spherical transducer element 1, while the depth of the counterbore 13 is approximately equal to the radius of the transducer element 1. Transducer element 1 is positioned directly over the center of the counterbore 13, and is supported by a polyurethane column 14 formed as part of the flow fairing 6.

Counterbore 13 functions as an acoustic trap to prevent sound waves from impinging on the lower hemisphere of the transducer element 1, thereby improving the performance of the listening apparatus of the present invention. As shown in FIG. 6, an acoustic wavefront 15 impinges the acoustic baffle 4 at an angle of approximately 45° to the upper plane of the acoustic baffle 4. Although acoustic baffle 4 is designed to absorb the acoustic wavefront 15, it is possible that in the absence of counterbore 13 some portion of the acoustic wavefront 15 might be reflected off of the acoustic baffle 4 and onto the lower hemisphere of the transducer element 1, resulting in degradation of the desired hemispheric response pattern. The possibility of such an undesirable degradation is eliminated by this embodiment. The counterbore 13 ensures that any portion of the wavefront 15 reflected off of the acoustic baffle 4 glances off at an angle sufficient to bypass the transducer element 1.

Figure 7:
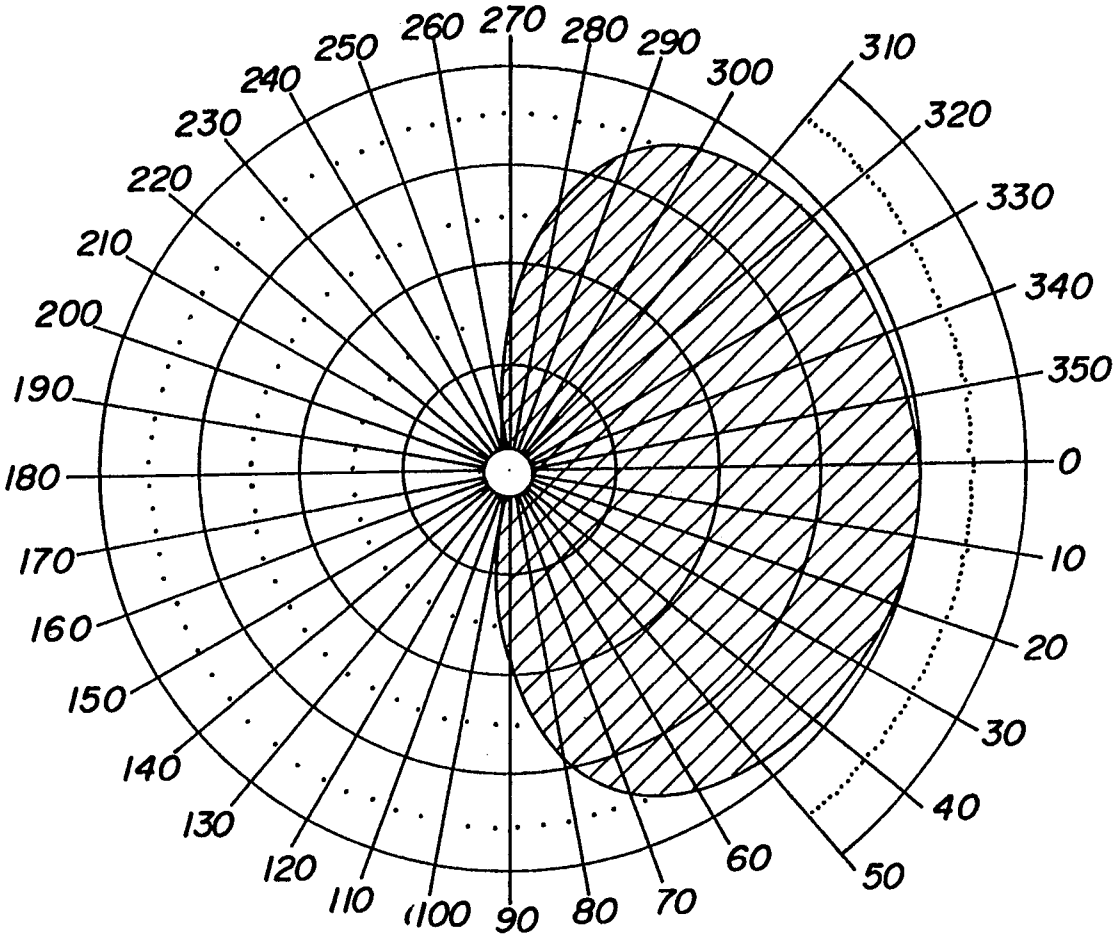
FIG. 7 is a graphical depiction of the hemispheric isonification pattern achieved by the present invention.

The present invention has been shown to cause a normally omnidirectional hydrophone to exhibit a substantially hemispheric isonification pattern over a frequency range of 30 kHz to 200 kHz. FIG. 7 graphically depicts the actual isonification pattern achieved by the example apparatus of FIG. 3 for incoming sound waves at a frequency of 60 kHz. This and similar directional response patterns were obtained by producing short bursts of single-frequency tones using a sound-producing transducer stationed approximately two meters from the apparatus. The spherical transducer element of the apparatus faced the sound-producing transducer, while the acoustic baffle/acoustic shield were positioned perpendicular to an axis formed between the transducer element and the sound-producing transducer. For each frequency tested, the hydrophone was rotated incrementally between each repetitive sound burst to generate a locus of points on a polar plot that shows the resulting output voltage of a preamplifier coupled to the hydrophone in decibels as a function of the rotation angle. It was necessary to synchronize the single sine wave cycle sample taken near the beginning of the resulting burst of voltage from the preamplifier to account for the delay caused by the sonic travel time between the sound-producing transducer and the hydrophone.

As can be seen, the hemispheric isonification pattern is slightly deformed at the outer regions of the base of the hemisphere. This deformation is apparently due to the reflection of sound waves impinging the acoustic baffle at shallow grazing angles, and becomes more prominent as the frequency of the impinging sound waves increases.

The present invention achieves the goal of limiting the generation and detection of unwanted standing waves in the vicinity of the hydrophone. Table 1 below lists predicted standing wave ratios (VSWR) and reflection losses (RL) for an apparatus such as that shown in FIG. 3 for impinging sound waves across a range of frequencies. The data was generated using circuit analysis and modeling techniques well known in the art.

TABLE 1

| Frequency (Hz) | VSWR | RL |
|---|---|---|
| 10000 | 1.75 | −22.62 |
| 15000 | 7.33 | −4.77 |
| 20000 | 1.27 | −36.96 |
| 25000 | 5.29 | −6.64 |
| 30000 | 2.00 | −19.12 |
| 35000 | 4.44 | −7.97 |

TABLE 1-continued

| Frequency (Hz) | VSWR | RL |
|---|---|---|
| 40000 | 2.57 | −14.27 |
| 45000 | 3.83 | −9.29 |
| 50000 | 2.82 | −12.90 |
| 55000 | 3.28 | −10.94 |
| 60000 | 2.73 | −13.35 |
| 65000 | 2.78 | −13.09 |
| 70000 | 2.47 | −14.95 |
| 75000 | 2.40 | −15.44 |
| 80000 | 2.25 | −16.60 |
| 85000 | 1.20 | −41.40 |
| 90000 | 2.27 | −16.46 |
| 95000 | 2.37 | −15.60 |
| 100000 | 2.47 | −14.92 |

The standing wave ratio describes the ratio of reflected to incident sound waves, and is calculated as follows:

$$VSWR = \frac{1 + |\alpha|}{1 - |\alpha|},$$

where $\alpha$ is the complex coefficient of reflection for the acoustic baffle/acoustic shield combination. The return loss is the ratio of the reflected sound wave over the incident sound wave for the acoustic baffle/acoustic shield combination, and is calculated as follows:

$$RL = 20\log_{10}(\mu^2 + v^2),$$

where $\mu$ and $v$ are the real and imaginary components respectively of the complex coefficient of reflection for the mounting apparatus. The fluctuations in the values in Table 1 are caused by variations in the wavelengths of sound transmitted through the various layers at varying frequencies.

While the present invention is described with reference to specific embodiments, it will be apparent to those skilled in the art that many modifications and variations are possible. Accordingly, the present invention embraces all alternatives, modifications and variations that fall within the spirit and scope of the appended claims, as well as all equivalents thereof.

What is claimed is:

1. An apparatus for providing a hemispheric response pattern in transducing between acoustic signals in a fluid and electrical signals, said apparatus comprising:

an acoustic transducer including an active portion in the form of a sphere having a particular radius, and a particular circumference related to said particular radius;

an acoustic shield in the form of a plate defining a substantially planar surface;

an acoustic baffle in the form of an acoustically absorbent plate including substantially planar front and back surfaces, said acoustic baffle further defining a recess in said front surface of said acoustic baffle said recess having length and width dimensions in a plane parallel to said front surface which are substantially larger than said particular circumference, said recess also having a depth which is approximately equal to said particular radius; and mounting means for mounting said back surface of said acoustic baffle to said planar surface of said acoustic shield, and for mounting said active portion of said acoustic transducer outside, but centered over, said recess, and with the sphere which defines the outer surface of said acoustic transducer substantially tangent to a projection of said plane parallel to said front surface of said acoustic baffle, whereby said recess acts as an acoustic trap which prevents sound waves from impinging on that hemisphere of said active portion of said acoustic transducer which faces said recess.

* * * * *